United States Patent [19]

Boeckle et al.

[11] 3,999,406

[45] Dec. 28, 1976

[54] PANTIHOSE WAIST OPENING

[75] Inventors: Franz Boeckle, Herbertinger; Edmond Tovar, Denkendorf; Edmund Langmesser, Herbetingen, all of Germany

[73] Assignee: Firma Gottlieb Eppinger, Denkendorf, Germany

[22] Filed: Feb. 19, 1975

[21] Appl. No.: 551,118

Related U.S. Application Data

[63] Continuation of Ser. No. 412,147, Nov. 2, 1973, abandoned.

[30] Foreign Application Priority Data

| | | |
|---|---|---|
| Nov. 3, 1972 | Germany | 2253823 |
| Feb. 24, 1973 | Germany | 2309348 |
| Feb. 24, 1973 | Germany | 2309349 |
| Oct. 8, 1973 | Germany | 2350459 |

[52] U.S. Cl. ..... 66/177; 66/172 E

[51] Int. Cl.[2] ..... A41B 9/14

[58] Field of Search ..... 66/175, 176, 177, 147

[56] References Cited

UNITED STATES PATENTS

| | | | |
|---|---|---|---|
| 2,285,012 | 6/1942 | Burkey | 66/176 |
| 3,595,034 | 7/1971 | Safrit | 66/177 |
| 3,640,094 | 2/1972 | Piana et al. | 66/147 |
| 3,667,257 | 6/1972 | Butler | 66/147 |
| 3,670,529 | 6/1972 | Fregeolle | 66/177 |
| 3,673,821 | 7/1972 | Johnson | 66/177 |
| 3,748,870 | 7/1973 | Fregeolle | 66/177 |
| 3,815,385 | 6/1974 | Gariboldi | 66/172 R |
| 3,832,869 | 9/1974 | Shields | 66/147 |
| 3,834,191 | 9/1974 | Fregeolle | 66/147 |
| 3,834,192 | 9/1974 | Giraud | 66/147 |

FOREIGN PATENTS OR APPLICATIONS

| | | | |
|---|---|---|---|
| 2,070,477 | 9/1970 | France | 66/177 |
| 1,812,698 | 7/1969 | Germany | 66/177 |
| 1,957,656 | 5/1971 | Germany | 66/177 |
| 1,938,623 | 2/1970 | Germany | 66/177 |
| 7,302,860 | 10/1973 | Netherlands | 66/177 |

OTHER PUBLICATIONS

Goadby, D. R., Billis Pair of One-Piece Pantie-Hose, in Hosiery Trade Journal 80(954): pp. 99-100, June 1973.

*Primary Examiner*—Mervin Stein
*Assistant Examiner*—Andrew M. Falik

[57] ABSTRACT

Panti-hose knitted as a continuous tube with an area of fabric removed to form the waist opening in which elastic thread is incorporated in the fabric surfaces adjacent the waist opening primarily in those regions which are subject to stretch in the direction of the stitch courses. Elastic thread can also be incorporated in other regions to cause rolling in or folding over of the edges surrounding the waist opening, thereby improving the appearance, and reinforcing threads are also incorporated in some of the regions surrounding the waist opening.

27 Claims, 6 Drawing Figures

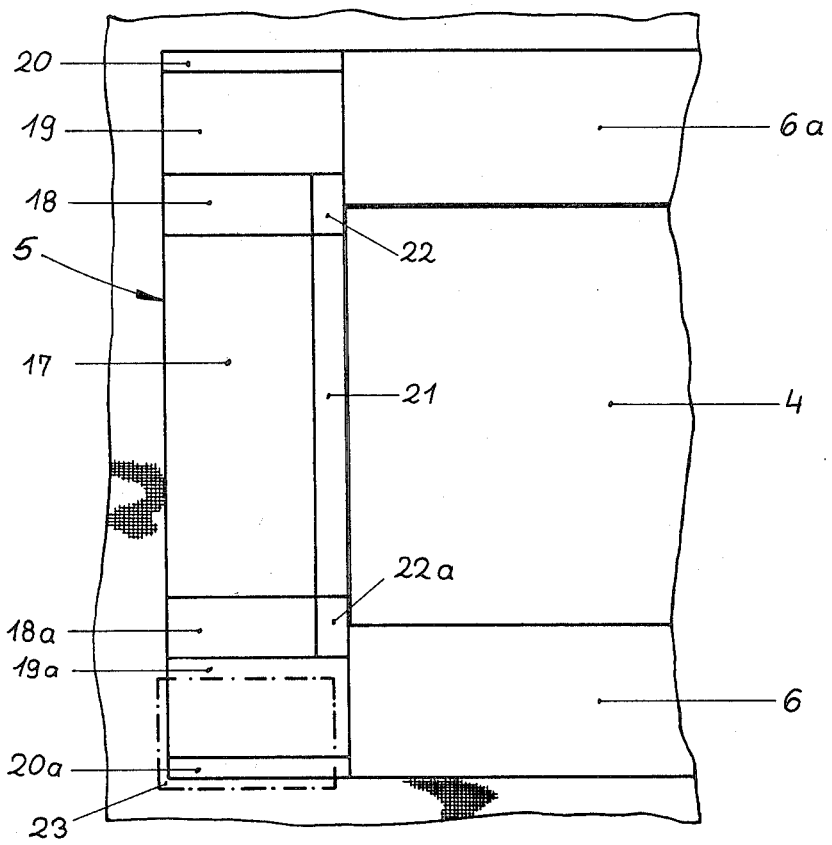
Fig.4
Fig.5
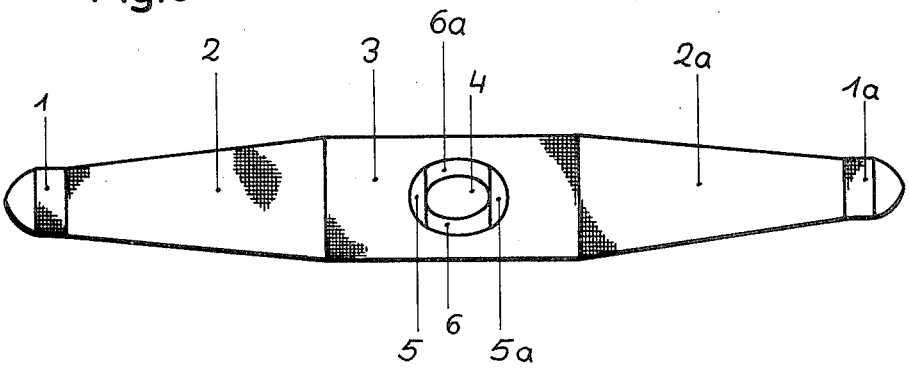

PANTIHOSE WAIST OPENING

This is a continuation of application Ser. No. 412,147, filed Nov. 2, 1973, now abandoned.

BACKGROUND OF THE INVENTION

The invention concerns single-tube panti-hoses whose waist opening is bounded by fabric surfaces which contain basic threads and elastic threads. Such tights are distinctive in that they are produced in a continuous operation on a circular knitting machine and that the two leg parts with the body part located between them form an integral tube whose stitch wales run in the longitudinal direction and whose stitch courses run in the circumferential direction. Although the invention is described hereinafter with respect to panti-hose and /or tights, it will be clear that the invention can also be used in connection with any other type of garment which calls for an elastic waist opening.

A particular problem in the production of the tights described lies in the provision of a waist opening and the arrangement there of the elastic waist band necessary for a good fit, since it is desired to prepare the tights on the knitting machine so no subsequent operations are required.

The already known attempts to provide single-tube tights with an elastic band, start from the point that the cut-out waist opening must be provided all round with an elastic band of good appearance, as is the case with tights produced in other ways. This leads to the disadvantage that the relatively expensive elastic thread material is also provided in positions where it is completely superfluous and takes no part at all in the good fit of the tights.

Therefore the problem underlying the invention is to provide tights with good fit for whose production as little elastic thread material as possible is necessary. Should it however be desired on visual grounds to use more elastic thread material than is absolutely necessary for the good fit of the tights, it is then a further aim of the invention to use this additional thread material at least in a manner which in some way, for example in visual regard, is still significant. Finally, it is also an underlying aim of the invention to provide as cheap as possible a process for the production of the said tights which can be carried out on a conventional stocking circular knitting machine.

SUMMARY OF THE INVENTION

Proceeding from the single-tube tights identified in the introduction, the invention consists in that the fabric surfaces which contain elastic thread material are only provided in those regions which in the wearing of the tights are subjected to stretching essentially in the direction of the stitch courses.

The invention brings with it the advantage that the elastic thread material is only provided where its stretch properties cannot be suppressed by the basic material, so that the production of the elastic band is extemely cheap.

According to a further feature of the invention the corner regions of the fabric surfaces containing elastic thread material which border the waist opening are provided at least partially with an increased stitch density. Thereby there results the additional advantage that the elastic threads are firmly bound in on both sides and that the corner regions can withstand all the tensile forces in the region of the waist opening without damage.

A further preferred embodiment of the invention is characterized in that those fabric surfaces, in which no elastic threads are provided, possess regions with different stretch properties. Thereby the further advantage is achieved that the stitch loops directly bordering the waist opening roll in on account of the different stretch properties so that a hard edge does not arise nor are the cut off thread ends visible.

Should it for any reason be desired to provide elastic thread material or an additional reinforcing thread in those fabric surfaces of tights which are produced only with the ground thread then it is proposed according to a further embodiment to form stitch courses of those two fabric surfaces which border the two side parts of the waist opening arranged with their long sides parallel to the stitchwales, so that these fabric surfaces possess a sharp fold line, running parallel to the stitch loops, along the regions of the fabric surfaces directly bounding the waist opening the folded line being folded over inwards about 180°.In this embodiment there arises the disadvantage, that the expensive elastic thread material is also used in regions of the band of the tights in which it can in no way improve the fit of the tights. However against this disadvantage stands the essential advantage that merely by the type of knitting style it can be ensured that the regions directly bordering the waist opening do not merely roll in but automatically fold over inwards about a defined fold line, so that no additional operation is necessary for the production of a band which is satisfactory also on visual grounds. In this manner the working in of elastic thread material brings with it advantages even at points where on other grounds it is essentially superfluous.

A process for the production of tights in accordance with the invention is characterized in that the fabric surface consisting of basic threads and elastic threads are formed of parts of those courses which adjoin the margin of the waist opening from below and above as seen in the direction of knitting. The waist opening is preferably formed by switching into the non-knitting track a number of knitting needles corresponding to the width of the waist opening and cutting out the threads which are thereby left floating.

Further characteristics Brief the invention are identified in the sub-claims.

BRIEF Description of the Drawings

The invention will be explained hereafter by reference to the drawing of embodiment examples.

FIG. 4 shows an enlarged portion of the waist band of the tights according to FIG. 1.

FIG. 5 shows schematically tights with an oval wasit opening.

DESCRIPTION OF THE PREFERRED EMBODIMENT

Figure 1:
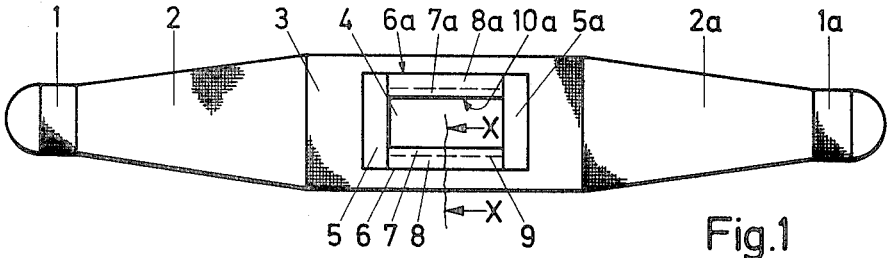
FIG. 1 shows schematically single-tube tights in accordance with the invention.

The single-tube tights shown schematically in FIG. 1 are knitted on a circular knitting machine in the form of a continuous tube, beginning, for example, at the one extremity 1, then producing one after the other the one leg 2, the body part 3 which is usually worked in stronger yarn, and the other leg 2*a* and finally the other extremity 1*a*, which like the extremity 1 can be automatically closed.

The waist opening 4 is preferably so produced that a large part of the fabric is cut away out of the body part 3. For this purpose, in the range of the width of waist opening 4 predetermined, for example 50 knitting needles are switched into the non-knitting track of the circular knitting machine, so that the thread provided for the production of the body part 3 is not worked into loops but is left floating and at each side and can be cut away with the aid of known cutting and clamping devices (c.f. for example German Pat. Specification No. 1,192,774) provided on the circular knitting machine. This process is repeated in sufficient courses until the waist opening 4 has the length required in the individual case, the number of these courses being selectable by alteration of the number of links in the counting chain of the circular knitting machine.

In accordance with the invention those fabric surfaces into which, in addition to the yarn provided for the body part 3, additional threads of elastic material are worked and which are marked 5 and 5*a* in FIG. 1. Such fabric surfaces are restricted to zones which, seen in the direction of the stitch wales, border the waist opening 4 above and below. Between the fabric surfaces 5 and 5*a*, which according to FIG. 1 are shown as rectangular, fabric surfaces 6 and 6*a* border the waist 4 on both sides. Those surfaces according to FIG. 1 also have a rectangular form and moreover can be reinforced with a non-elastic yarn, for example a textured yarn. These fabric surfaces 6 and 6*a* can however also contain an elastic thread material which is worked in a prescribed manner.

In the manner described there arises during an automatic knitting process a rectangular band, surrounding the waist opening 4 on all sides, which consists of the fabric surfaces 5, 6, 5*a* and 6*a* which touch each other and which essentially is only highly elastic in the region of the fabric surfaces 5 and 5*a*.

The tights described, even in the case when only the fabric surfaces 5 and 5*a* contain an elastic thread, possess, especially on the hip portion, such good stretch properties that the working of elastic thread material into the part of the band of the tights which during wear is at the front or the back can be completely eliminated.

According to FIG. 1 the fabric surfaces 6, 6*a* are preferably each divided into two regions 7 and 8 and, respectively, 7*a* and 8*a*, the regions 7, 7*a* possessing the stitch wales which directly border the waist opening and the regions 8, 8*a* possessing the remaining loops. The regions 7, 7*a* are plain-knitted whilst the regions 8, 8*a* are knitted in a tuck or missed pattern, for example 1:1 tuck and additionally can be reinforced by for example textured yarn. Because of the generally greater stretchability of the loops of the regions 7, 7*a* in comparison with the loops of the regions 8, 8*a*, no hard edge can form at the direct margin of the waist opening 4. Moreover the regions 7, 7*a* automatically roll themselves in, so that the cut off thread ends are not visible.

The regions 7, 7*a* directly bordering on the opening 4 extend, for example, over 10 loops, the adjacent regions 8, 8*a* by contrast for example over 22 loops.

Figure 2:
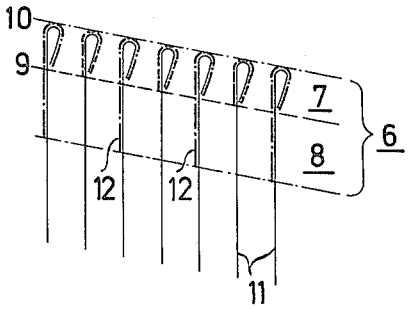
FIGS. 2 and 3 show single-tube tights whose waist opening is enclosed round about with fabric surfaces, which contain the basic thread and an elastic thread.
Figure 3:
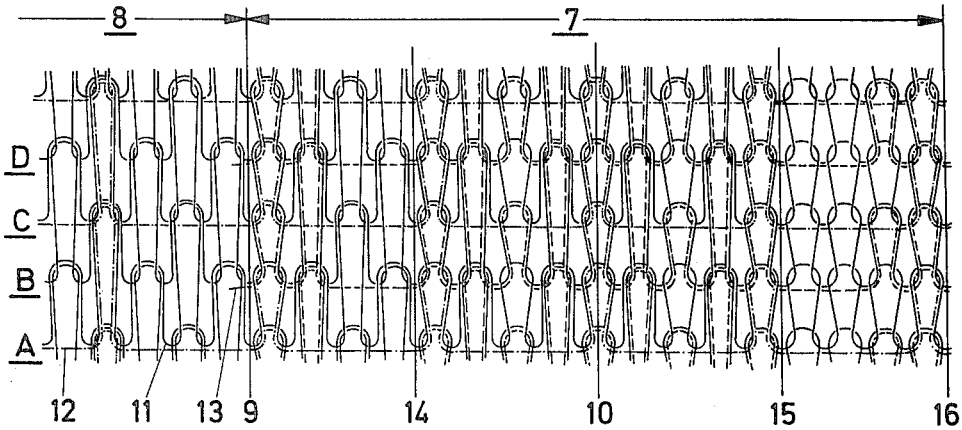

According to FIGS. 1 to 3 the fabric surfaces 6, 6*a* can also be each divided by separating lines 9 into two regions 7, 8 and 7*a*, 8*a*, the separating lines 9 of these fabric surfaces each extending parallel to the wales, that is to the side parts of the waist opening 4, and elastic thread material being worked only into the regions 7, 7*a* directly bounding the waist opening. By choice of a special style of knitting it is moreover ensured that the regions 7, 7*a* are wrapped over on themselves along fold lines 10, 10*a*, "wrapped over" meaning in this case not the rolling in in the usual manner, as for example occurs perforce and in an undesired way at the beginning or end of a tube-like article produced on a circular knitting machine, but a desired folding over of a fabric surface about some 180° in the manner of the upper edge of a welt formed through wraps or also in the manner of a crease, in which the fold is limited to a zone of one or only a few stitch wales.

In a preferred embodiment of the invention the fold lines 10, 10*a* are produced on a four-feed circular knitting machine as follows:

First the tights in the region of the body 3 are knitted in a pattern which is called 1:1 — tuck (racked) and is achieved by knitting and tucking alternately on all needles with a basic thread 11 in the first and third knitting feeds and in the second and fourth knitting feeds or tucking with those needles with which in the two other feeds tucking or knitting, respectively, was done.

This style of knitting is altered in the fabric surfaces 6, 6*a*, namely first in that in the regions 8 and 8*a* a reinforcement thread 12 (chain dotted) is fed to each fourth needle in addition to the ground thread 11 (FIGS. 2 and 3), in that these needles for example are lifted up through the loop-clearing position in order to take up the reinforcement thread as well as the ground thread 11, while the three needles lying in between merely leave the reinforcement thread 12 floating. In the example shown in FIG. 3 the working in of the reinforcement thread 12 begins at a position starting to the left of the specimen shown with the aid of the first knitting feed labelled A and the third feed labelled C.

Beginning at the separating line 9 between the regions 7, 8 or 7*a*, 8*a* a thread 13 of elastic thread material is inserted at the second feed labelled B and the fourth feed labelled D. This thread 13 is worked into the whole region 7, 7*a*, it being generally sufficient if the regions 7, 7*a* extend over less than twenty loops. In the embodiment example of FIG. 3 the threads 13 are bound in into the knit structure by being first taken up by two adjacent needles and worked into a stitch or a tuck and then they are left floating by the next two needles. Next the threads 13 are worked by nine successive needles into stitches or tucks, resulting in the part of the fabric bounded by lines 14 and 15 in FIG. 3. Then the threads 13 are again left floating by two adjacent needles and worked into stitches by two further needles so that they are firmly bound into the part of the fabric between the lines 15 and 16. Finally the threads 13, the ground threads 11 and the reinforcing threads 12 are cut off along the line 16.

The fold line 10 which is not of a rolled configuration such as is the case for the top and bottom coursewise ends of a knit tubular piece produced on a circular knitting machine, consists in distinctive form only of the middle of those stitch groups consisting of nine stitches in which the additional threads 13 are worked into each second course of stitches with retention of the 1:1 tuck (racked) knitting style used in the body part, while in the courses in between the additional reinforcing threads 12 are worked in.

The distinctive folding over of the fabric in the region of the fold line 10, 10*a* can be further improved if in the preceding or following feed of the nine successive needles working between the lines 14 and 15 only the first middle and last needle is used for the working of the reinforcing thread, that is to say working in a 1:3 missing pattern.

Finally the folding over is also further encouraged when in those portions into which the elastic thread 13 is worked, small stitches are formed. Thereby the band formed by the regions 7, 8 and 7*a*, 8*a* possesses moreover a better appearance and a greater durability in comparison to the usually essentially more loosely worked remaining regions of the body part 3. The last one to five loops of the article shown in FIG. 3 which directly border the line 16 are preferably knitted plain in all courses throughout, in order to obtain better stretch in the direction of the stitch loops.

As elastic thread materials are suitable for the purposes of the invention not only the usual, for example rubber-like threads consisting of elastomers, but also elastic high twist yarns which should have the same twist direction in all the feeds that are used. In one embodiment a 50/13/1 Helanca thread was used as the ground thread 11, a 78/13/1 Helanca thread as the reinforcing thread 12 and a rubber-elastic thread with 235 Decitex as the thread 13.

The invention is not limited to the styles of knitting described with reference to FIGS. 2 and 3. Similar turn-over effects can be achieved for example if the elastic thread 13 is knitted normally evenly in the region between the lines 14 and 15 and/or the reinforcing thread is worked in not in the ratio 1:3 but in another ratio or just evenly. Correspondingly for the production of the fold line 10, 10*a* other types of knitting or other numbers of stitches between the lines 14 and 15 could be chosen.

For the prevention of ladders, or runs run resist courses can be knitted on the end of the region 5 provided with elastic yarn. Moreover a double layer fabric in the manner of a welt can be provided at those two points at which the fabric surfaces 5 and 5*a* border the waist opening 4.

Figure 6:
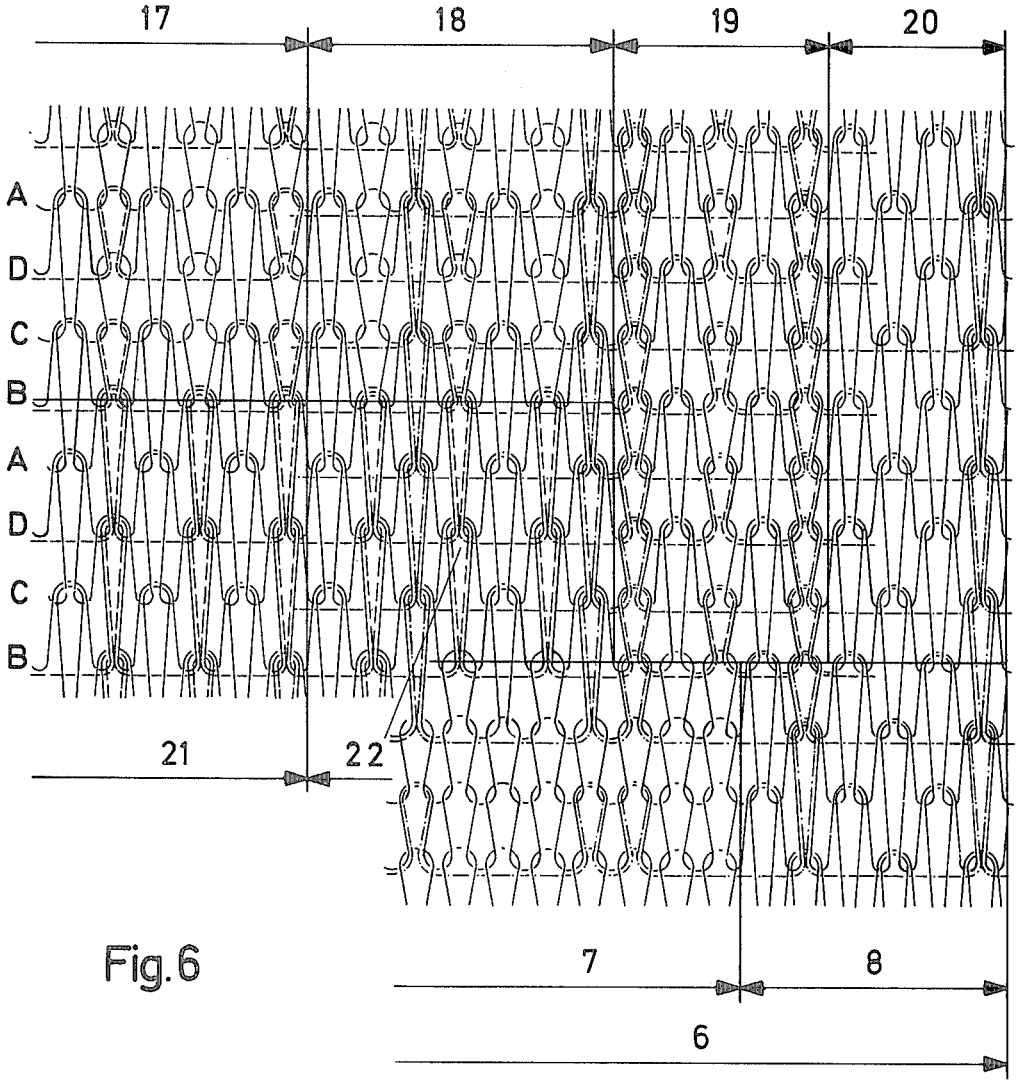
FIG. 6 shows in detail the loop structure of the upper left section of FIG. 4.

According to FIG. 4 and FIG. 6. the fabric surface 5, and correspondingly the fabric surface 5*a* which is not shown, is divided into several sections 17 to 22*a*, of which the section 17 forms a middle region and the sections 18 to 22 or 18*a* to 22*a* each form a corner region. The corner regions may have an increased stitch density, wherein increased stitch density means knitting a thread with more needles per inch or adding to a ground thread a reinforcing thread or knitting a portion with smaller, tighter loops or varying the style of knitting in any way to increase the mass of the fabric per square inch. The various sections, using a circular knitting machine with four units as a basis, are produced as follows:

In section 17 the elastic thread material is taken up in the first and third feed by each fourth needle in addition to the basic thread and worked into a stitch, so that it is left floating each time at the back of three intervening needles, which has the result of a large stretchability of the section 17 in the direction of the stitch courses. The style of knitting in the first and third feed is preferably 1:1 tuck, whilst the second and fourth feed, in which only the basic thread is knitted, are worked plain.

In the sections 18 and 18*a* the same choice of needles is provided as in the section 17, but in the second and fourth feeds there is fed additionally to each fourth needle a reinforcing thread which is left floating by the remaining intervening needles and at the boundary between the sections 17 and 18 or 18*a* is cut off in the usual way. In contrast to section 17, in which each second course contains elastic thread material, the sections 18, 18*a* thus contain in successive courses alternately elastic thread material and reinforcing threads.

The sections 19, 19*a* are distinguished in comparison with the section 17 on the one hand in that the elastic thread material in the first and third feeds is picked up and worked into a stitch by every second needle, whilst on the other hand in the first and third feeds it is knitted evenly plain and correspondingly in the second and fourth feed in the knitting style 1:1-tuck. In other words in opposition to section 17, where it is reversed, here an even course with elastic thread material is followed by a 1:1 tuck course without elastic thread material, in which the same needle which in the preceding unit worked the elastic thread material into a stitch, likewise forms a stitch. Moreover in the units II and IV as in the sections 18, 18*a*, the reinforcing thread is worked with every fourth needle.

The sections 20, 20*a* contain in addition to the ground thread the reinforcing thread which in the second and fourth feed is fed to each fourth needle, while the elastic thread material is cut away in the usual manner at the boundary between the sections 19, 20 or 19*a*, 20*20*. The style of knitting is for example 1:1 tuck in the first and third feed and 1:1 tuck (racked) in the second and fourth feed, i.e., 1:1 tuck wherein the tuck stitches are staggered from line to line; On account of this special manner of knitting in the section 19, 19*a* the danger of the elastic threads pulling out in the use of the tights minimized.

In the section 21 adjacent the section 17, which directly borders the waist opening 4, a protection against ladders is preferably provided. This can for example be achieved if in contrast to the section 17 in the first and third feed each second needle picks up and works into a stitch the elastic thread material, whilst those needles which in the first and third feed have picked up the elastic thread material are only brought to the tucking height in the following second and fourth feed. The style of knitting is preferably 1:1 tuck (racked) in all four feeds. Through this ladder protection it is true that the stretchability of the section 21 is comparison with the section 17 is reduced but the stretch properties of the whole middle regions 17, 21 are only slightly influenced thereby when the section 21 extends only over a few courses.

The sections 22 and 22*a* which are connected at each side to the section 21 and each of which is arranged on both sides of the edge of the waist opening 4 which runs in the direction of the stitch loops, differ from the sections 21 merely in that in the second and fourth feeds corresponding to the sections 19, 19*a* or 20, 20*a* additionally the reinforcing thread is fed to each fourth needle.

An additional anchoring of the ends of the elastic thread material in the sections 19, 19*a* or of the reinforcing thread ends in the sections 20, 20*a* can be achieved if in each of the sections 19, 20 or 19*a*, 20*a* a security zone 23 is provided whose border line according to FIG. 2 can run out from the sections 19, 20 or 19*a*, 20*a* into the remaining body part. The security zone 23 is characterized by small tight stitches and preferably, in order to avoid hardness at the edges bordering the waist opening 4, does not extend out into the sections 21, 22 or 22*a*. The tight stitches can be formed by all or selected feeds. The style of knitting in the portions 7 and 8 of FIG. 6 is altered as compared with the embodiment of FIG. 3.

According to a specific embodiment the sections 19, 20 or 19*a*, 20*a* each extend over 136 courses, while the section 17 stretches over one hundred and twelve and the section 21 over 24 courses. The width of the sections 17 and 21 amounts to one hundred needles, the width of the sections 18, 22 and 18*a*, 22*a* each to twenty needles, the width of the sections 19, 19*a* each twelve needles and finally the width of the sections 20, 20*a* each ten needles.

The invention is not limited to the described sections 17 – 23 of the preferred embodiment example since it is possible to use the various sections according to requirements individually or in particular combinations as well as in case of need to supplement them with further sections or execute them in other styles of knitting. Also the number of needles which in the invdividual sections take up and work into stitches the elastic thread material and/or the reinforcing thread, can be matched to various requirements.

According to FIG. 5 the waist opening 4 can also be given an oval form. In this embodiment preferably two fabric surfaces 5 and 5*a* of circular segmental form bound the waist opening 4 above and below while between these two fabric surfaces two similarly circular segmental fabric surfaces 6 and 6*a* are formed. The outer limits of the band formed by the regions 5, 6, 5*a* and 6*a* preferably run substantially parallel to the edge of the oval waist opening.

For the formation of the oval waist opening 4 according to FIG. 5 a device is necessary on the circular knitting machine by means of which an increasing and decreasing number of knitting needles can be switched into the non-knitting course and each of the fabric surfaces 5, 5*a* 6 and 6*a* can be provided with a continually increasing or decreasing width. Known devices of this kind work with beak jacks (compare for example German Patent Specification No. 1,251,456).

We claim

1. A one-piece rotary knitted garment of the class including panti-hose and tights comprising a single continuous seamless knitted tube forming a pair of leg portions and a panty portion therebetween with all knitted wales extending lengthwise and with all knitted courses extending circumferential of said panty portion and said leg portions, said panty portion having a waist opening with a length corresponding to a plurality of courses and a width corresponding to a substantial plurality of wales, said waist opening being surrounded by two first and two second fabric regions, said first regions substantially extending lengthwise of said tube and said second regions substantially extending circumferential of said tube, wherein only said second regions are knitted with thread material comprising elastic yarn so that said elastic yarn is provided only in those regions bordering said waist opening which in wearing of the garment are subject to stretch essentially in the direction of the courses of said tube.

2. A garment according to claim 1, wherein said first regions are reinforced with textured yarn.

3. A garment according to claim 1, wherein said first regions have at least first and second portions, said first portions bordering said waist opening and said second portions being spaced from said waist opening by said first portions, said first and second portions having different stretching properties such that the wales of said first portions roll in.

4. A garment according to claim 3, wherein said first portions have in comparison with said second portions an increased stretchability in the direction of the wales.

5. A garment according to claim 4, wherein said first portions are plain-knitted and said second portions are knitted in a tuck pattern.

6. A garment according to claim 4, wherein said first portions are plain-knitted and said second portions are knitted in a float pattern.

7. A garment according to claim 3, wherein said second portions are reinforced by incorporating into said portions a reinforcing yarn.

8. A garment according to claim 1, wherein said first regions are formed in such a knitting style that these regions possess a fold line substantially extending parallel to the wales along which fold line the first regions are folded over inwards through about 180°.

9. A garment according to claim 1, wherein said first regions each have a middle region and two corner regions, said corner regions extending circumferentially on both sides of said middle regions and being provided at least partially with an increased stitch density in comparison with said middle regions.

10. A garment according to claim 9, wherein the increased stitch density is produced by working in a reinforcing yarn.

11. A garment according to claim 9, wherein the increased stitch density is produced by providing a zone consisting of small tight stitches.

12. A garment according to claim 9, wherein said increased stitch density is produced by variation of the style of knitting.

13. A garment according to claim 9, wherein elastic thread material is incorporated into every second loop in the corner regions and into every fourth loop in the middle regions.

14. A garment according to claim 9, wherein elastic yarn is incorporated into every second loop course of said second regions.

15. A garment according to claim 14, wherein also reinforcing yarn is incorporated into every second loop course of said corner regions in such a way that courses with elastic yarn and courses with reinforcing yarn alternate.

16. A garment according to claim 9, wherein the courses of the middle regions are knitted alternately 1:1 tuck and plain, the corner regions on the contrary being at least partially knitted alternately plain 1:1 tuck such that the courses being knitted 1:1 tuck in said corner regions are plainknitted in said middle regions and vice versa.

17. A garment according to claim 9, wherein the middle regions are divided into two sections, one section bordering the waist opening and being run-proof.

18. A one-piece rotary-knitted garment of the class including panti-hose and tights comprising a single continuous seamless knitted tube forming a pair of leg portions and a panty portion therebetween with all knitted wales extending lengthwise and with all knitted courses extending circumferential of said panty portion and said leg portions, said panty portion having a waist opening with a length corresponding to a plurality of courses and with a width corresponding to a plurality of wales, said waist opening being surrounded by two first and second fabric regions, said first regions substantially extending lengthwise of said tube and said second fabric substantially extending circumferential of said tube, wherein said first regions are formed in such a knitting style that these regions possess a fold line substantially extending parallel to the wales, along which fold line the portions of said first regions which border said waist opening, are folded over inwards through some 180° in the manner of a crease with said fold being limited to a small zone of wales, and wherein elastic yarn is incorporated into said second regions.

19. A garment according to claim 18, wherein said first regions alternately have courses into which elastic yarn; and reinforcing yarn is incorporated.

20. A garment according to claim 18, wherein said alternating courses also include a ground thread being knitted 1:1 tuck.

21. A garment according to claim 19, wherein said reinforcing yarn is knitted and missed in the proportion 1:3.

22. A garment according to claim 18, wherein that wales of said first regions which border said waist opening, and a few neighboring wales are plain-knitted in all courses.

23. A garment according to claim 19, wherein the portions of said first regions which include said elastic yarn have a smaller stitch size than other portions of said panty portions.

24. A garment according to claim 18, wherein the waist opening is formed by cutting out of a part from said panty portion.

25. A garment according to claim 18, wherein said second regions each have a middle region and two corner regions, said corner regions extending circumferentially on both sides of each of said middle regions and being provided at least partially with an increased stitch density in comparison with said middle regions.

26. A one-piece rotary knitted garment of the class including pantyhose and tights knitted on a circular knitting machine and comprising a single continuous knitted tube having a panty portion with all knitted wales extending lengthwise and with all knitted courses extending circumferentially of said tube, said panty portion having a waist opening formed by cutting out a part of said panty portion during rotary knitting and having a length corresponding to a plurality of courses and a width corresponding to a substantial plurality of wales, said waist opening being surrounded by two first and two second fabric regions, said regions also being formed during continuous rotary knitting, wherein said first regions substantially extend lengthwise of said tube and said second regions substantially extend circumferentially of said tube and wherein said first and second regions form an integral waist band of the garment.

27. A garment according to claim 26, wherein said second regions are knitted with thread material including elastic thread material so that said elastic thread material is provided at least in those regions bordering said waist opening which in wearing of the garment are subject to stretch essentially in the direction of the courses of said tube.

* * * * *